US005498136A

United States Patent [19]

Namura et al.

[11] Patent Number: 5,498,136

[45] Date of Patent: Mar. 12, 1996

[54] FLUID MACHINERY HAVING BLADE APPARATUS AND BLADE APPARATUS FOR FLUID MACHINERY

[75] Inventors: Kiyoshi Namura, Toukai; Eiji Saito, Hitachi; Masakazu Takasumi, Jyuou; Kazuo Ikeuchi, Hitachi, all of Japan

[73] Assignee: Hitachi, Ltd., Tokyo, Japan

[21] Appl. No.: 307,463

[22] Filed: Sep. 19, 1994

[30] Foreign Application Priority Data

Sep. 17, 1993 [JP] Japan ..... 5-231184

[51] Int. Cl.[6] ..... F01D 5/22; F01D 5/24

[52] U.S. Cl. ..... 416/190; 416/191; 416/193 R; 416/196 R

[58] Field of Search ..... 416/190, 191, 416/193 R, 194, 195, 196 R, 500

[56] References Cited

U.S. PATENT DOCUMENTS

| | | | |
|---|---|---|---|
| 3,584,971 | 6/1971 | Ortolano | 416/191 |
| 3,588,278 | 6/1971 | Ortolano et al. | 416/195 |
| 4,662,824 | 5/1987 | Ortolano | 416/196 R |

FOREIGN PATENT DOCUMENTS

| | | | |
|---|---|---|---|
| 531364 | 8/1931 | Germany | 416/194 |
| 112406 | 9/1979 | Japan | 416/196 R |
| 99213 | 6/1982 | Japan | 416/196 R |
| 31601 | 2/1986 | Japan | 416/196 R |
| 310103 | 12/1989 | Japan | 416/195 |
| 30902 | 2/1990 | Japan . | |

*Primary Examiner*—Edward K. Look
*Assistant Examiner*—James A. Larson
*Attorney, Agent, or Firm*—Antonelli, Terry, Stout & Kraus

[57] ABSTRACT

The total number (M) of plural blades of a blade apparatus is selected so as not to be a prime number and not to be a power multiplier of a prime number. Plural blades are divided into at least a first blade group in which one blade group has the blades of a first integer number ($N_1$) and a second blade group in which one blade group has blades of a second integer number ($N_2$). Each of the first integer number ($N_1$) and the second integer number ($N_2$) have no common divisor except 1. The total number (M) of plural blades is the product of the first integer number ($N_1$) and the second integer number ($N_2$). The blades of the first integer number ($N_1$) blade group are connected by a first stage connecting member and the blades of the second integer number ($N_2$) blade group are connected by a second stage connecting member.

12 Claims, 16 Drawing Sheets n : EVEN n : ODD

FLUID MACHINERY HAVING BLADE APPARATUS AND BLADE APPARATUS FOR FLUID MACHINERY

BACKGROUND OF THE INVENTION

The present invention relates to an improvement in fluid machinery having a blade apparatus, such as a steam turbine, a gas turbine, a compressor and a fan, and to a blade apparatus employed in these fluid machineries. More particularly, the invention relates to a blade apparatus for fluid machinery in which the blades are connected by connecting members to each other and to fluid machinery having such a blade apparatus.

In a conventional and generally employed blade apparatus for fluid machinery, such as a steam turbine, a gas turbine, a compressor and a fan, in order to avoid changing the conformation or shape of the blade apparatus itself, and so as to heighten the rigidity function and the vibration damping function, there has been adopted widely a blade connecting structure in which the blades around an outer peripheral portion of a blade wheel are connected to each other by connecting members.

Many kinds of blade connecting structures for the blades in such fluid machinery have been selected and adopted to comply with the demands and the purpose of use. A case of a blade apparatus having a connecting member adopted for use in an axial flow turbine will be exemplified referring to FIG. 2 to FIG. 7.

Since these connecting structures are well known generally, a detailed explanation thereof will be omitted herein. In general, the connecting structure is classified mainly into two basic structures, namely one structure in which tip portions of blades 1 are connected by a shroud or a cover 3*a* and the root or base portions are connected by a blade wheel 2 to each other (confer from FIG. 2 to FIG. 4), and another structure in which a longitudinal intermediate portion of each blade 1 is connected by a rod 3*b* or a tie wire 3 (confer from FIG. 5 to FIG. 7).

Within the above blade connecting structures, a case (corresponding to FIG. 5) in which the tie wire 3 is arranged around the periphery of the blade wheel 2 will be shown schematically from FIG. 8 to FIG. 10.

In these figures, to simplify the explanation, the total number M of the blades 1 around the periphery of the blade wheel 2 is twenty (20), namely M=20. Further, two kinds of the tie wires 3 are provided, in which one kind of tie wire 3A is arranged at a certain radial position of the blade 1 and another kind of tie wire 3B is arranged at another certain radial position of the blade 1, namely a case comprising a two-stage connecting structure is shown.

Further, in this case, it is not necessary for the installing radius of the tie wires 3A and 3B to be different, but there is a case in which the tie wires 3A and 3B are arranged at the same installing radial positions and at the same distance. The above stated blade connecting structure having more than two kinds of connecting members is referred to hereinafter as a multiple stage blade connecting blade structure.

In FIG. 8, in the blade connecting structure, each blade group comprises four blades 1 and these blades 1 are connected in each group by a first stage tie wire 3A and a second stage tie wire 3B. Five (5) blade groups are formed around the periphery of the blade wheel 2.

As stated above, the blade structure each blade group is formed by a finite number of blades and such a blade group is arranged repeatedly in the circumferential direction around the blade wheel 2. The above blade structure is referred to in general as a finite blade group or called simply a blade group.

In the case of this figure, each of the double connecting members is provided in the same number for the blade group, and the blade group and all of the cutoff portions (non-connecting portions of the connecting members which form a space between adjacent blade groups) of the blade group are positioned at the same circumferential position.

On the contrary, FIG. 9 shows a blade apparatus in which all of blades 1 around the periphery are connected by a first stage tie wire 3A and a second stage tie wire 3B without the cut-off portions, and hereinafter this blade apparatus is referred to as a whole periphery one ring structure. This figure shows a double whole periphery one ring structure.

FIG. 10 shows a compound structure combining the blade group structure having the tie wires 3A shown in FIG. 8 with the whole periphery one ring structure having the tie wire 3B shown in FIG. 9.

As the prior art relating to the above stated blade apparatuses, Japanese patent laid-open No. 30902/1992 will be listed as one example.

Since the blades of the thus formed blade apparatus are combined respectively, these blades are constituted to provide mechanical security and are valid. Herein, the blade apparatus will be taken under consideration from an aspect of vibration.

Each of FIG. 11 and FIG. 12*a*–FIG. 12*e* shows an example of a natural vibration mode in a blade group structure, and in particular FIG. 12*a*–FIG. 12*e* show, respectively, a different vibration mode in the case in which the blade group structure is viewed from the radial direction.

Namely, FIG. 11 is a partial view showing the blades 1 and FIG. 12*a* is a view showing in plane level a condition of a vibration width $L_1$. Further, along the entire periphery of one ring structure, because of the coupled vibration of all the blades around the periphery, it is well known to have a series of natural vibration mode groups which are referred to as nodal diameter modes, as shown in FIG. 13. In this figure, a dashed line Q shows a nodal line of the vibration.

As to the natural vibration mode of the compound structure (FIG. 10), formed by a combination of the blade group structure and the whole periphery one ring structure, from the relationship of the function according to the present invention, the explanation thereof is omitted herein, however, it will be explained again in later part of this specification.

Further, for purposes of this description, it will be considered that each natural vibration mode resonates by the action of an excitation force on the blade structure. As the excitation force acting on the blades of the fluid machinery, the most popular influence is caused by the fluid.

FIG. 14 is a schematic view of the component of the excitation force in a case in which a flow extending over the whole periphery of the blade wheel is non-uniform.

In accordance with Fourier analysis of the fluid force repeated for every rotation of the turbine, it is well known that the fluid force is divided into an excitation force having a frequency component which corresponds to an integer number times of the rotation speed (hereinafter referred to as an excitation order and expressed by the symbol j).

When the above stated excitation force acts on the blades, a first resonance condition is that the blade natural frequency coincides with the excitation frequency corresponding to an integer number of the rotation speed. In the blade group shown in FIG. 8, it is well known that, so long as the above first resonance condition is satisfied, the blade group can resonate in almost all excitation orders.

The resonance condition of the blades along the entire periphery of the one ring structure as shown in FIG. 9 is also well known. However, in addition to the above stated first resonance condition, it is necessary to note that the following equation will hold as a second resonance condition.

Namely, $$j \pm k = \lambda M \quad (1)$$

Herein,

λ: zero (0) or positive integer number;

k: nodal diameter number of natural vibration mode of blades having whole periphery one ring structure;

M: total blade number around the periphery.

In this specification, the explanation about Equation (1) is not stated in detail; at any rate, when the above stated condition is satisfied, a resonance occurs.

Ordinary fluid machinery generally is designed so that a resonance having a high vibration stress does not occur, or it is designed for affording strength so as not to cause a problem even if resonance occurs.

However, in fluid machinery for performing a load operation extending over a wide rotation speed range, there are many cases in which there is difficulty in designing the fluid machinery so as to avoid resonance for all natural vibration modes of the blades.

Further, in accordance with the dimension and the shape of the blades or the change in the material of the blades, it is frequently the case that the fluid machinery is designed for affording increased strength.

Further, flutter exists as a self-excited vibration of the blades of the fluid machinery. However, flutter differs from the forced vibration produced by the above stated fluid force.

In the case of flutter, since energy is supplied from fluid accompanying minute vibration of the blades, flutter is a vibration which possibly occurs at the rotation speed corresponding to resonance, except for the resonance rotation speed in which the above stated first condition is satisfied.

As a result, taking account of these situations, it is difficult to obtain fluid machinery having a blade apparatus in which a self-excited vibration rarely occurs and in which a high reliability is attained.

SUMMARY OF THE INVENTION

The present invention has been developed in view of the above considerations. Thus, an object of the present invention is to provide a blade apparatus for fluid machinery wherein, without a change in the shape or the conformation of the blade, the blade apparatus does not produce a resonance condition even when it receives excitation from the fluid, or, even when the resonance occurs, the vibration stress is very small. Further, self-excited vibration, such as flutter, hardly occurs.

Namely, in accordance with the present invention, a blade apparatus for fluid machinery is constituted in which plural blades are mounted on an outer periphery of a blade wheel, the plural blades are divided into predetermined blade groups, plural blades of the divided blade groups are connected to each other by plural connecting members, and plural connecting members are formed in plural stages comprised of at least a first stage connecting member and a second stage connecting member.

The blade apparatus for the fluid machinery is characterized in that the total number (M) of plural blades is selected so as to be neither a prime number nor a power multiplier of a prime number, the plural blades are divided into at least a first blade group in which one blade group has blades of a first integer number ($N_1$) and a second blade group in which one blade group has blades of a second integer number ($N_2$), each of the first integer number ($N_1$) and the second integer number ($N_2$) having no common divisor except 1, the total number (M) of plural blades is the product of the first integer number ($N_1$) and the second integer number ($N_2$), the blades of the first integer number ($N_1$) blade group are connected by a first stage connecting member, and the blades of the second integer number ($N_2$) blade group are connected by a second stage connecting member.

Next, the operation of the thus formed blade apparatus will be explained. Before starting to this explanation, so as to facilitate an understanding of the invention, the natural vibration mode of the compound structure shown in FIG. 10 will be explained.

In this compound structure of a blade apparatus, since one connecting member is formed along the whole periphery as a one ring structure, by the coupling of the vibrations of the blades around the periphery, similar to the natural vibration mode of the whole periphery of the one ring structure previously shown in FIG. 13, there is a nodal diameter mode having a nodal diameter number of 0–M/2.

However, since the other connecting structure is a blade group structure in which four blades are formed by the connecting structure as one blade group, one natural vibration mode of the compound structure comprises not only a single nodal diameter mode, like the whole periphery one ring structure, but also has simultaneously several nodal diameter modes.

The periodicity of the structure extending over the whole periphery of the compound structure shown in FIG. 10 will be explained. First of all, considering the whole periphery of the one ring structure, the same connecting structure is repeated on one blade as a period unit, and considering the blade group structure, the same blade structure is repeated as four blade groups five times as a periodic arrangement.

When these connecting structures are viewed totally as a double connecting structure, it is seen that the same blade structure is repeated as four blade groups five times as a periodic arrangement. The above compound structure is referred to as a compound periodic structure.

Herein, when the number of the periodic structure extending over the whole periphery is expressed as n (in the example shown in FIG. 10, n=5), a certain natural vibration mode of the compound periodic structure, in which the blades around the periphery are connected by the connecting members and the number of the period structure extending over the whole periphery is n, has a natural vibration mode having a nodal diameter number k which is expressed by the following relationship equation.

$$k = \epsilon n \pm 1 \quad (2)$$

Herein,

1: integer number ($0 \leqq 1 \leqq n/2$);

ϵ: integer number ($0 \leqq 1 \leqq m/2$);

m: constructive blade number of one period structure.

A detailed explanation with respect to Equation (2) is omitted herein, however the combination of the nodal diameter number k included within one natural vibration mode is given as a combination which satisfies the Equation (2) with respect to the various numbers $\epsilon$, when the number 1 is given.

According to the above stated relationship represented by Equation (2), taking two cases in which the numbers n are even and odd, nodal diameter modes having one natural vibration mode are shown schematically in FIG. 15 and FIG. 16.

The horizontal axis of each figure indicates the integer number 1 of Equation (2) and the vertical axis of each figure indicates the nodal diameter number k, and in each figure a zigzag line expressing the relationship between the integer number 1 and the number k is indicated.

In these figures, the manner in which one natural vibration mode of the compound periodic structure is constituted by the overlapping of various kinds of nodal diameter modes is given by the nodal diameter numbers k at the intersection points where the zigzag line intersects with the given integer number 1.

More specifically, in the example of the compound periodic structure shown in FIG. 10, the natural vibration mode becomes as shown in FIG. 17. Namely, in this example, the number n is 5 (n=5), accordingly the integer number 1 takes the values of 0, 1 and 2. Further, since the number m is 4 (m=4), $\epsilon$ has the values of 0, 1 and 2. As one example, assuming that the given integer number 1=1, the combination of the number k becomes 1, 4, 6 and 9.

From the above stated facts, when by analogy the extreme case is considered, in case of the integer number n= 1, namely when the blade structure has a total blade number M around the periphery so as to form one period structure, in accordance with the Equation (2), the integer number 1 becomes only 1=0.

Using the schematic figure shown in FIG. 18, it can be considered that one natural vibration mode includes the vibration mode of all nodal diameter numbers of 0–M/2.

As stated above, since the blade connecting structure according to the present invention is a blade structure in which the total blade number M around the periphery represents one period, in each one natural vibration mode, the vibration modes of all nodal diameter numbers of 0–M/2 are included.

Therefore, even when the blade connecting structure receives excitation from a fluid, the blade connecting structure does not resonate or resonates so that the vibration stress becomes very small.

Next, with respect to the reasons why the blade connecting structure does not resonate or resonates so that the vibration stress becomes very small will be explained as follows.

Generally, in the case that the blades resonate by receiving excitation from a fluid, when the energy added to the blades by the excitation force and the energy consumed by the damping become equal, a balanced condition of resonance is presented.

When the excitation force of some excitation order j shown in FIG. 14 acts on blades having nodal diameter natural modes, the condition for resonance (the condition in which the energy is added to the blades from the excitation force) is, as understood from the above Equation (1), that the excitation order j coincides with the nodal diameter number k in a certain natural vibration mode. This fact is well known, of course.

On the contrary, even if the vibration modes having various nodal diameter numbers are included in one natural vibration mode, the energy is not added to the blades from the excitation force, except for the vibration mode having an equal nodal diameter number. On the other hand, the energy consumed by the damping is proportional to the maximum kinetic energy of the entire blade structure.

When the vibration modes extending over the whole periphery are constituted by an overlap of the vibration modes of several nodal diameter numbers, the maximum kinetic energy is expressed by the sum of the kinetic energy of every vibration mode of each nodal diameter number.

As a result, when some natural vibration mode is received by the excitation of the excitation order j, within the natural vibration modes, only one vibration mode having a nodal diameter number k coinciding with the excitation order j can receive energy.

On the other hand, the energy consumption according to vibration damping is performed for the vibration modes of all nodal diameter numbers within the natural vibration modes.

Therefore, as shown by the present invention, in the blade connecting structure which includes the vibration modes of all nodal diameter numbers of 0–M/2, in comparison with the energy which is added by excitation, since the energy consumed by the vibration damping becomes comparatively large, resonance does not occur, and even if resonance occurs, the vibration response becomes very small, so that problems which could destroy the blade by excitation do not occur.

Similarly, in the case where flutter energy is supplied to the blade from the fluid, it is considered that the energy is supplied only to the specific nodal diameter mode in a certain vibration mode of the blade.

In comparison with the above, since the energy consumption according to the vibration damping in the vibration modes of all nodal diameter numbers of 0–M/2 becomes relatively large, the flutter will hardly occur.

As explained above, according to the present invention, this kind blade apparatus for fluid machinery and fluid machinery having a blade apparatus can be obtained without a change in the shape or the conformation of the blade, resonance does not occur even when excitation is received from the fluid, or the vibration stress is very small even when resonance occurs, and a high safety with respect to flutter is achieved, thereby to attain a high reliability of the fluid machinery having a blade apparatus.

DESCRIPTION OF THE INVENTION

Figure 39:
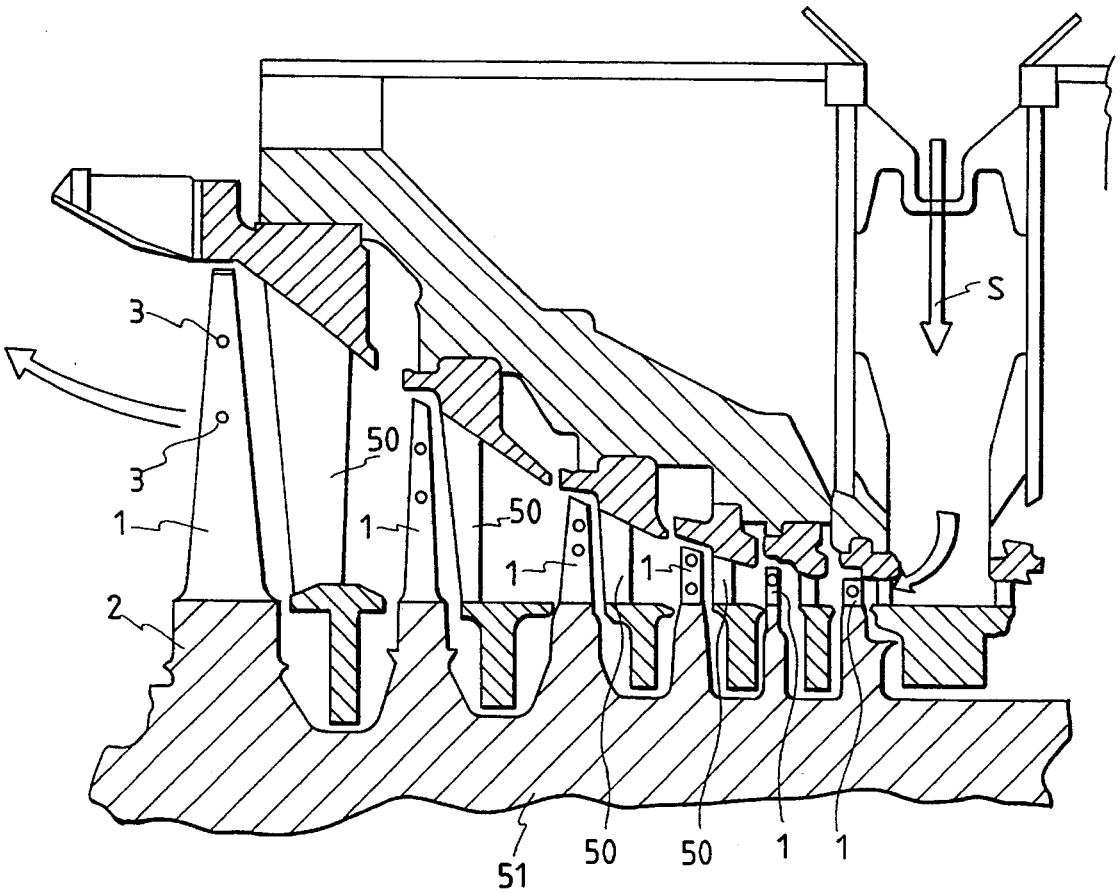
FIG. 39 is a vertical cross-sectional view showing an essential portion of a fluid machine according to the present invention.

Hereinafter, the present invention will be explained in detail with reference to an illustrated embodiment. In FIG. 39, an essential portion of a steam turbine, representing one kind of the fluid machinery having a blade apparatus, is shown in cross-section.

A steam turbine is composed mainly of stator blades 50 arranged at a stator side and rotor blades 1 arranged at a rotor side through a blade wheel (a disc) 2. The stator blades 50 and the rotor blades 1 are provided in plural stages, and further, the respective blades 50 and 1 are arranged mutually with a predetermined interval in a peripheral direction of the steam turbine.

High pressure steam S supplied from a boiler (not shown in the figure) is introduced into a steam inlet port from outside the stator and is injected toward the rotor blades 1 through the stator blades 50 so as to drive a rotative shaft 51. In general, the steam turbine is constituted such that a generator is combined with an end portion of this rotative shaft 51 and this generator generates electricity.

Figure 1:
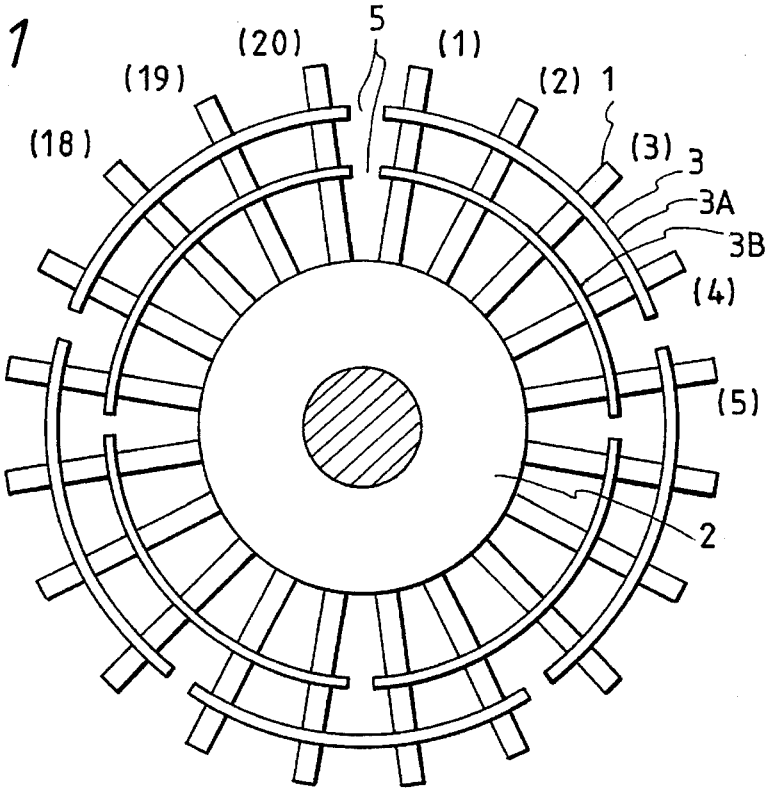
FIG. 1 is a front view showing one embodiment of a blade apparatus according to the present invention.

The rotor blades 1 are held on an outer periphery of the disc 2 with an interval in the peripheral direction, and the rotor blades 1 are combined with each other by connecting members. FIG. 1 shows schematically an example of the rotor blade 1.

Plural blades 1 are arranged on the disc 2. In the case of the present invention, the total number (M) of the blades 1 is important, the total number (M) of the blades 1 provided on one disc 2 being selected as follows.

Namely, the total number M of the blades 1 provided on the disc 2 is selected so as to not be a prime number or not be a number representing a power multiplier of a prime number. Then, the selected plural number of the blades 1 is expressed by the product of two integers ($N_1$, $N_2$), each integer ($N_1$, $N_2$) having no common divisor except 1. The total number (M) of the blades 1 is a product of the two integers ($N_1$, $N_2$), namely $M=N_1 \times N_2$.

In this example, the total number (M) of the blades 1 is twenty (M=20). However, the total blade number (M) is not limited to twenty but may be selected as other numbers which satisfy the above stated condition. However, so as to simplify the explanation, an example having a total blade number M=20 is shown.

Figure 19:
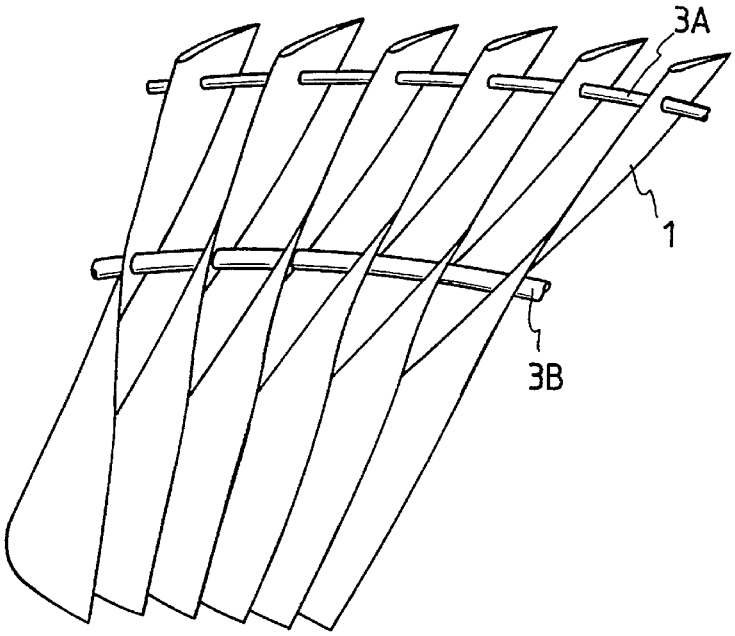
FIG. 19 is a partial view showing a blade group structure which is connected by a tie wire.

The blades 1 installed on the disc 2, as shown in enlarged view in FIG. 19, in a certain radial position (a first stage, a tie wire 3A), are connected by a tie wire 3 as a connecting member, and also, in another certain radial position (a second stage, a tie wire 3B), are also connected by a tie wire 3 as a connecting member.

In accordance with the present invention, the relationship of the number of blades 1 which are connected by the respective tie wire 3 (3A, 3B) is important. In this case the blade number in one glade group connected by the first stage tie wire 3A is four and the four blade group structure is repeated five times around the periphery of the disc 2.

Besides, the blade number in one blade group connected by the second stage tie wire 3B is five and this five blade group structure is repeated four times around the periphery. Here, it is should be noted that the blade number in one blade group connected by the first stage tie wire 3A is interchangeable with that of the second stage tie wire 3B.

Figure 20:
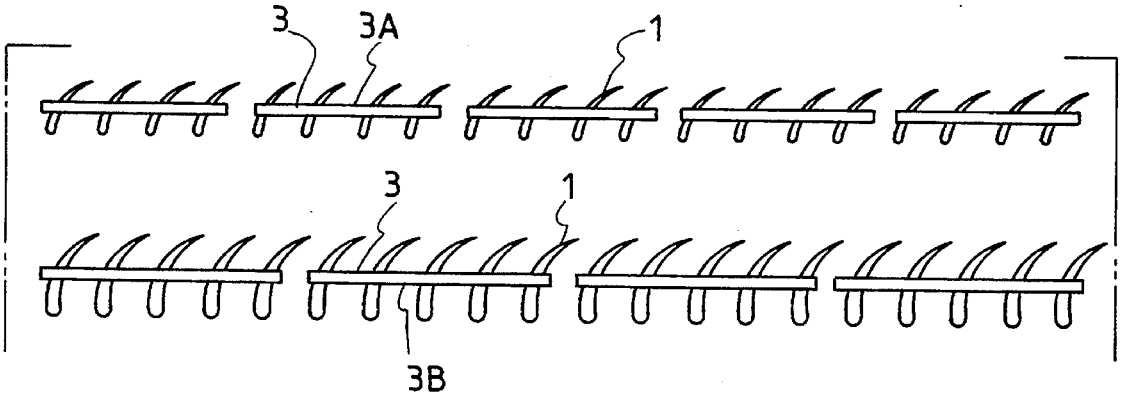
FIG. 20 is a developing plan view showing a blade cross-section for installing a connecting member of a blade structure of a first embodiment according to the present invention.

FIG. 20 shows a structure having the above stated connecting condition for the blades. This figure is a plan view showing the blade cross-section in the respective installing radius development extending over the whole periphery.

Looking at it from a different viewpoint, this is the structure in which, with respect to the first stage tie wires 3A, the cut-off portions exist every four blades 1, and, with respect to the second stage tie wires 3B, the cut-off portions exist every five blades 1.

Returning to FIG. 1, with respect to the blade apparatus thus formed, it can be seen that the same connecting structure is repeated every certain number of blades along the circumference. In this case, the first blade clockwise from the position where the cut-off portions of the first stage tie wire 3A and the second stage tie wire 3B overlap circumferentially is defined as the No. (1) blade.

In FIG. 1, it can be seen that the blade connecting structure of the same blade group is not repeated until coming back again to the blade No. (1) through the blade No. (20). Therefore, it will be understood that the blade connecting structure of all the blades around the periphery are formed as one period.

Further, the above example relates to the case of a total blade number M=20. The product of two integers for making M=20 is 2×10, as well as 4×5. However, 2 and 10 have the common divisor of 2, in which case the same two blade connecting structures are repeated with a period of ten blades 1 around the periphery, with the result that it will definitely not constitute blade connecting structure in which all the blades 1 around the periphery are formed as one period.

Further, for reference, examples of the blade total number (M) related to the above stated product of two integers are listed in Tables 1 and 2.

TABLE 1

| M | prime resolution | blade connecting number combination ($N_1$-$N_2$) |
|---|---|---|
| 1 | | — |
| 2 | prime | — |
| 3 | prime | — |
| 4 | $2^2$ | — |
| 5 | prime | — |
| 6 | $2 \times 3$ | 2-3 |
| 7 | prime | — |
| 8 | $2^3$ | — |
| 9 | $3^2$ | — |
| 10 | $2 \times 5$ | 2-5 |
| 11 | prime | — |
| 12 | $2^2 \times 3$ | 4-3 |
| 13 | prime | — |
| 14 | $2 \times 7$ | 2-7 |
| 15 | $3 \times 5$ | 3-5 |
| 16 | $2^4$ | — |
| 17 | prime | — |
| 18 | $2 \times 3^2$ | 2-9 |
| 19 | prime | — |
| 20 | $2^2 \times 5$ | 4-5 |
| 21 | $3 \times 7$ | 3-7 |
| 22 | $2 \times 11$ | 2-11 |
| 23 | prime | — |
| 24 | $2^3 \times 3$ | 8-3 |
| 25 | $5^2$ | — |
| 26 | $2 \times 13$ | 2-13 |
| 27 | $3^3$ | — |
| 28 | $2^2 \times 7$ | 4-7 |
| 29 | prime | — |
| 30 | $2 \times 3 \times 5$ | 2-15, 6-5, 3-10 |
| 31 | prime | — |
| 32 | $2^5$ | — |
| 33 | $3 \times 11$ | 3-11 |
| 34 | $2 \times 17$ | 2-17 |
| 35 | $5 \times 7$ | 5-7 |
| 36 | $2^2 \times 3^2$ | 4-9 |
| 37 | prime | — |
| 38 | $2 \times 19$ | 2-19 |
| 39 | $3 \times 13$ | 3-13 |
| 40 | $2^3 \times 5$ | 8-5 |
| 41 | prime | — |
| 42 | $2 \times 3 \times 7$ | 2-21, 3-14, 6-7 |
| 43 | prime | — |
| 44 | $2^2 \times 11$ | 4-11 |
| 45 | $3^2 \times 5$ | 9-5 |
| 46 | $2 \times 23$ | 2-23 |
| 47 | prime | — |
| 48 | $2^4 \times 3$ | 16-3 |
| 49 | $7^2$ | — |
| 50 | $2 \times 5^2$ | 2-25 |
| 51 | $3 \times 17$ | |
| 52 | $2^2 \times 13$ | 4-13 |
| 53 | prime | — |
| 54 | $2 \times 3^3$ | 2-27 |
| 55 | $5 \times 11$ | 5-11 |
| 56 | $2^3 \times 7$ | 8-7 |
| 57 | $3 \times 19$ | 3-19 |
| 58 | $2 \times 29$ | 2-29 |
| 59 | prime | — |
| 60 | $2^2 \times 3 \times 5$ | 4-15, 3-20, 5-12 |

TABLE 2

| M | prime resolution | blade connecting number combination ($N_1$-$N_2$) |
|---|---|---|
| 61 | prime | — |

TABLE 2-continued

| M | prime resolution | blade connecting number combination ($N_1$-$N_2$) |
|---|---|---|
| 62 | $2 \times 31$ | 2-31 |
| 63 | $3^2 \times 7$ | 9-7 |
| 64 | $2^6$ | — |
| 65 | $5 \times 13$ | 5-13 |
| 66 | $2 \times 3 \times 11$ | 2-33, 3-22, 6-11 |
| 67 | prime | — |
| 68 | $2^2 \times 17$ | 4-17 |
| 69 | $3 \times 23$ | 3-23 |
| 70 | $2 \times 5 \times 7$ | 2-35, 5-14, 7-10 |
| 71 | prime | — |
| 72 | $2^3 \times 3^2$ | 8-9 |
| 73 | prime | — |
| 74 | $2 \times 37$ | 2-37 |
| 75 | $3 \times 5^2$ | 3-25 |
| 76 | $2^2 \times 19$ | 4-19 |
| 77 | $7 \times 11$ | 7-11 |
| 78 | $2 \times 3 \times 13$ | 2-39, 3-26, 6-13 |
| 79 | prime | — |
| 80 | $2^4 \times 5$ | 16-5 |
| 81 | $3^4$ | — |
| 82 | $2 \times 41$ | 2-41 |
| 83 | prime | — |
| 84 | $2^2 \times 3 \times 7$ | 4-21, 3-28, 7-12 |
| 85 | $5 \times 17$ | 5-17 |
| 86 | $2 \times 43$ | 2-43 |
| 87 | $3 \times 29$ | 3-29 |
| 88 | $2^2 \times 11$ | 8-11 |
| 89 | prime | — |
| 90 | $2 \times 5 \times 9$ | 2-45, 5-18, 9-10 |
| 91 | prime | — |
| 92 | $2^2 \times 23$ | 4-23 |
| 93 | $3 \times 31$ | 3-31 |
| 94 | $2 \times 47$ | 2-47 |
| 95 | $5 \times 19$ | 5-19 |
| 96 | $2^5 \times 3$ | 32-3 |
| 97 | prime | — |
| 98 | $2 \times 7^2$ | 2-49 |
| 99 | $3^2 \times 11$ | 9-11 |
| 100 | $2^2 \times 5^2$ | 4-25 |
| 101 | prime | — |
| 102 | $2 \times 51$ | 2-51 |
| 103 | prime | — |
| 104 | $2^3 \times 13$ | 4-13 |
| 105 | $3 \times 5 \times 7$ | 3-35, 5-21, 7-15 |
| 106 | $2 \times 53$ | 2-53 |
| 107 | prime | — |
| 108 | $2^2 \times 3^3$ | 4-27 |
| 109 | prime | — |
| 110 | $2 \times 5 \times 11$ | 2-55, 5-22, 11-10 |
| 111 | $3 \times 37$ | 3-37 |
| 112 | $2^4 \times 7$ | 16-7 |
| 113 | prime | — |
| 114 | $2 \times 3 \times 19$ | 2-57, 3-38, 6-19 |
| 115 | $5 \times 23$ | 5-23 |
| 116 | $2^2 \times 29$ | 4-29 |
| 117 | $3^2 \times 13$ | 9-13 |
| 118 | $2 \times 59$ | 2-59 |
| 119 | prime | — |
| 120 | $2^3 \times 3 \times 5$ | 8-15, 3-40, 5-24 |

The blade apparatus is formed as described above, namely the blade connecting structure having blades disposed around the periphery as one period. In the above-described blade connecting structure, within one natural vibration mode, the vibration modes of all nodal diameter numbers are included; and as stated above, energy consumption by vibration damping is carried out in the vibration modes of all nodal diameter numbers within the natural vibration mode.

In this blade connecting structure, because the energy consumed by the vibration damping becomes relatively very large in comparison with the energy added by the excitation, resonance will hardly occur; and, even if resonance occurs, the vibration response becomes very small.

Further, concerning the flutter energy supplied to the blade from the fluid, it is found that the energy is supplied to only the specific nodal diameter mode of one vibration mode in the blades. On the other hand, the energy consumption by vibration damping within the vibration modes of all nodal diameter numbers of 0–M/2 is relatively large and, as a result, flutter hardly occurs.

In the above-stated explanation, for example, the space (the cut-off portion) of the first stage tie wire 3A is shown to exist at an interval of every four blades 1 connected by the first stage tie wire 3A, however it is unnecessary always to provide such a space.

From a viewpoint in which the same blade connecting structures are repeated, it is unnecessary to have the above stated spacing. In this regard, it may be enough merely to have a different connecting condition for each portion of the first stage and the second stage tie wires 3A and 3B, which corresponds to the cut-off portion, in comparison with the space between other blades 1.

Figure 21:
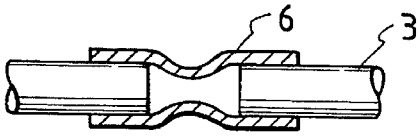
FIG. 21 is a vertical cross-sectional view showing a sleeve which connects a tie wire.

Namely, for example, in these portions, it is possible for the first stage and the second stage tie wires 3A and 3B to be formed extremely thin, or conversely, to be formed extremely thick. On the other hand, as shown in FIG. 21, end portions of the first stage and the second stage tie wires 3A and 3B can be connected loosely to each other through a flexible sleeve 6 which is softer than the tie wires 3A and 3B.

Further, the portion 5 (FIG. 1), where the spaces of the first and the second stage tie wires 3A and 3B overlap circumferentially, will be explained supplementarily. It is desirable from the aspect of strength that a blade 1 around the periphery is connected to both the front and rear blades at least at one radial portion.

Thereby, at the portion 5 in which the cut-off portions of the first stage and the second stage tie wires 3A and 3B overlap, even in the case where at least one side tie wire has no cut-off portion, the blade connecting structure having blades around the periphery as one period can be achieved.

Figure 22:
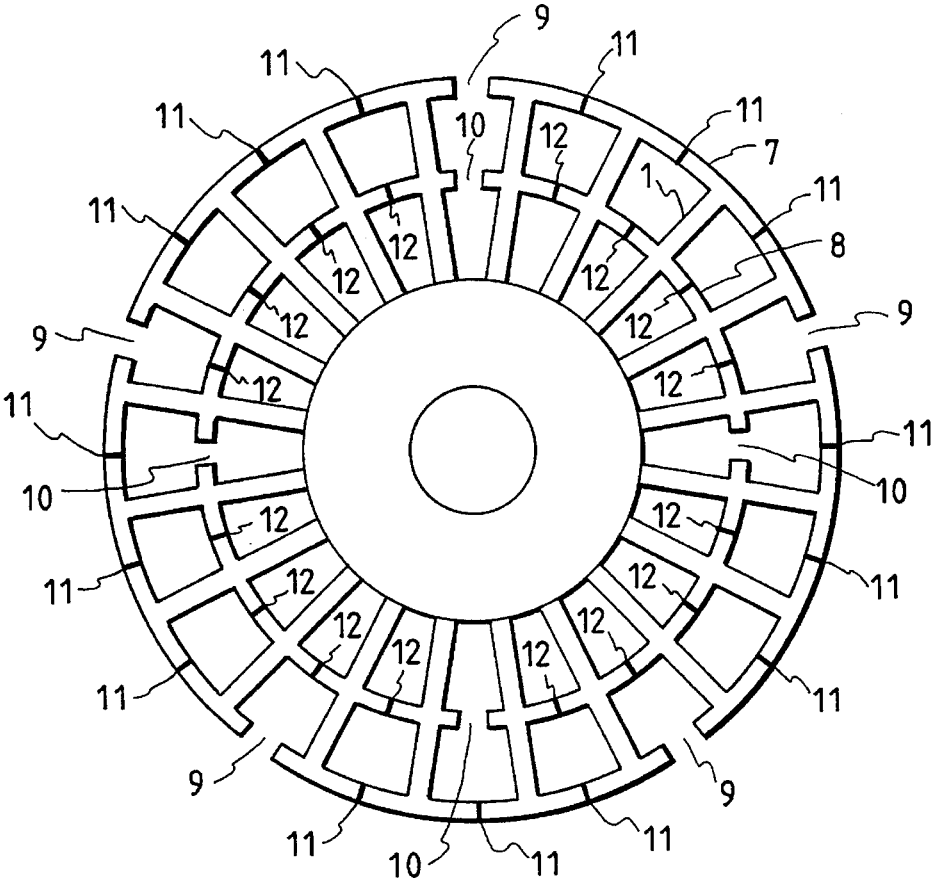
FIG. 22 is an axial front view showing a blade structure of a second embodiment according to the present invention.

Next, referring to FIG. 22 and FIG. 23, a second embodiment according to the present invention will be explained. In this second embodiment, the concept of selecting a total blade number for the disc and a blade number for one blade group are same as the above-described embodiment, however this embodiment shows the case of a different connecting member and a different manner for connecting by the connecting members.

Namely, the blade 1 provides at a tip portion a cover 7 formed integrally with the blade 1, and at an intermediate portion, a rod 8 is formed integrally with the blade 1. The covers 7, being adjacent each other, or the rods 8, being adjacent each other, are formed so as to effectively connect the blades under a contacting condition, respectively.

Figure 24:
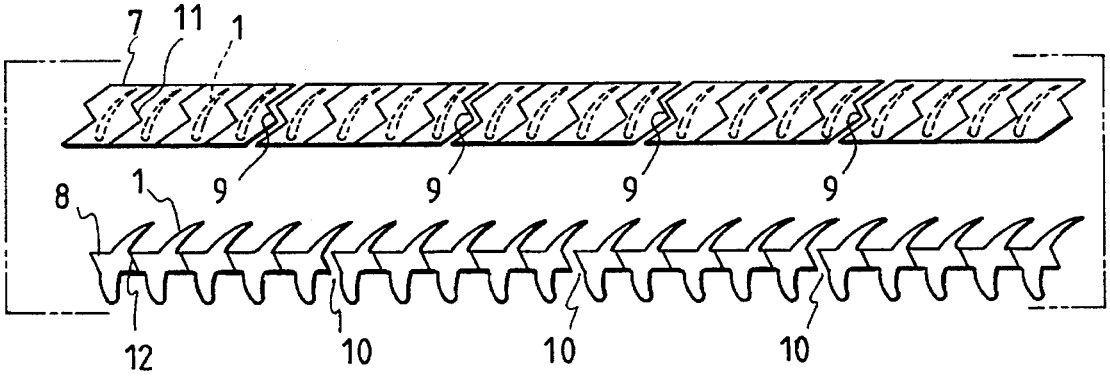
FIG. 24 is a developing plan view showing a blade cross-section for installing a connecting member of a blade structure of a second embodiment according to the present invention.

FIG. 24 is a plan view showing a blade cross-section of the tip portion cover 7 and the intermediate portion rod 8 in respective radial direction positions in development extending over the blades 1 around the periphery.

In the blade connecting structure in which the covers 7 or the rods 8 are connected to each other under a contacting condition, when the blades 1 have comparatively long blade lengths and are twisted along the radial direction, it is well known that, due to centrifugal force during the rotation of the steam turbine, an untwist (twist back) phenomenon occurs.

Figure 25:
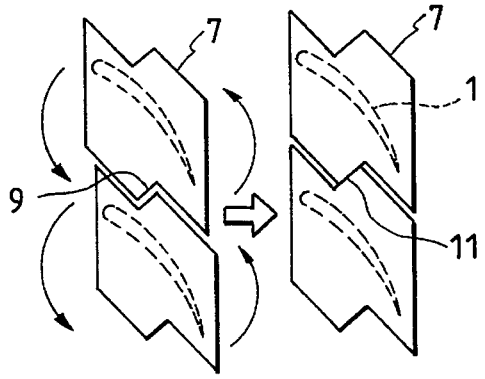
FIG. 25 is a plan view showing the untwisting of a cover portion formed integrally with a blade.
Figure 26:
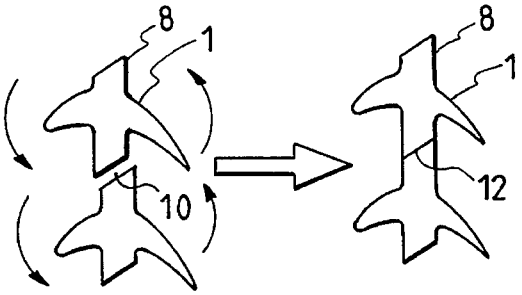
FIG. 26 is a plan view showing the untwisting of a rod portion formed integrally with a blade.

With respect to the above, the untwist phenomenon of the tip cover portion 7 and the intermediate rod portion 8 and the manner for restricting the untwist movement by contacting the covers 7 with each other and the rods 8 with each other will be shown in the plan views of FIG. 25 and FIG. 26.

In FIG. 25, a gap 9 is formed between portions of the cover 7 and this cover 7 becomes smaller when untwist occurs, so that by and by the gap 9 is reduced to zero, and the adjacent\covers 7 start to contact, whereby the untwist is restricted.

Accordingly, when the untwist moments acting on the blades 1 are the same, the more the gap 9 is small initially, the more the force for restricting the untwist becomes strong, and, as a result, the connecting force between the adjacent blades 1 becomes strong.

Namely, according to the size of the gap 9, the connecting force between the adjacent blades 1 varies. Before the rotation of the steam turbine, when the gap 9 is set beforehand to be zero, the strongest connecting force is obtained.

The above matters can be applied similarly to a gap 10 of the intermediate rod portion 8 and the connecting force of the blades 1 shown in FIG. 26. FIG. 23 and FIG. 24 show the installing conditions of the blades 1 before the rotation of the steam turbine, respectively.

With respect to the cover portion 7, the gaps 9 are formed at intervals of every four blades 1 and so as to form a zero gap between all other blades 1; namely, the gaps are adjusted to reduce the gap 11 to zero. The gap 11 having zero space is defined as a zero gap 11 in this specification.

Besides, with respect to the rod portion 8, the gaps 10 are formed at intervals of every five blades 1 and so as to form a zero gap between all other blades 1, namely the gaps have been adjusted to have a gap 12 which is zero. The gap 12 having zero space is defined as a zero gap 12 in this specification.

Accompanying an increase in the rotation of the steam turbine, according to the untwist phenomenon, the connecting force acts on the zero gap 11 of the cover portion 7 and the zero gap 12 of the rod portion 8.

Besides, the gaps 9 and 10 becomes narrower due to the increase of an untwist angle accompanying the rise in rotation of the steam turbine, and before long, the gaps 9 and 10 become zero, so that from this time point a connecting force acts on the blades 1.

As understood from the above explanation, extending over the whole periphery, the connecting force of the cover portion 7 changes periodically at intervals of every four blades 1 and that of the rod portion 8 changes at intervals of every five blades 1.

As a result, according to the blade connecting structure which incorporates the cover portion 7 and the rod portion 8, the blade structure is formed to have blades 1 around the whole periphery as a structure of one period.

Figure 23:
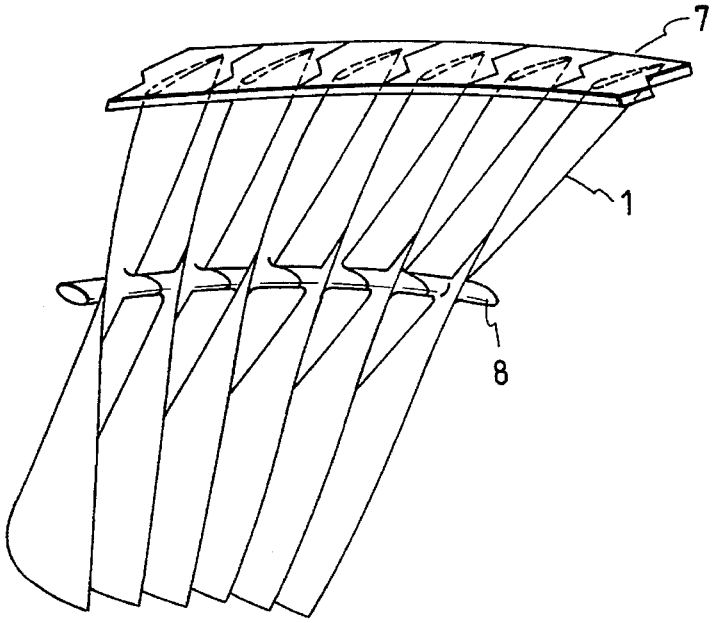
FIG. 23 a partial view showing a blade structure which is connected by a cover and a rod formed integrally with a blade.

In the case in which the adjacent blades 1 are connected utilizing the untwist forces, the manner of selection of the gaps 9 and 10 is not limited only to the examples shown in FIG. 23 and FIG. 24. As stated above, it is preferable to realize the periodicity of the connecting force.

Figure 27:
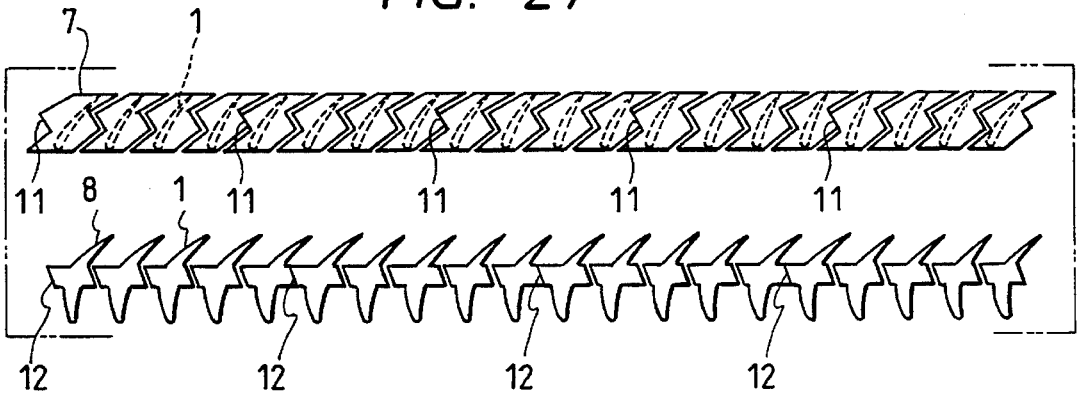
FIG. 27 is a developing plan view showing a blade cross-section for installing a connecting member of a blade structure of a second embodiment according to the present invention.

For example, as shown in FIG. 27, with respect to the cover portion 7, the zero gap 11 is provided at intervals of every four blades 1, and with respect to all other blades 1, they can be adjusted to a finite gap 9. Further, with respect to the rod portion 8, the zero gap 12 is provided at intervals of every five blades 1, and with respect to all other blades 1, they can be adjusted to have a finite gap 10.

Figure 28:
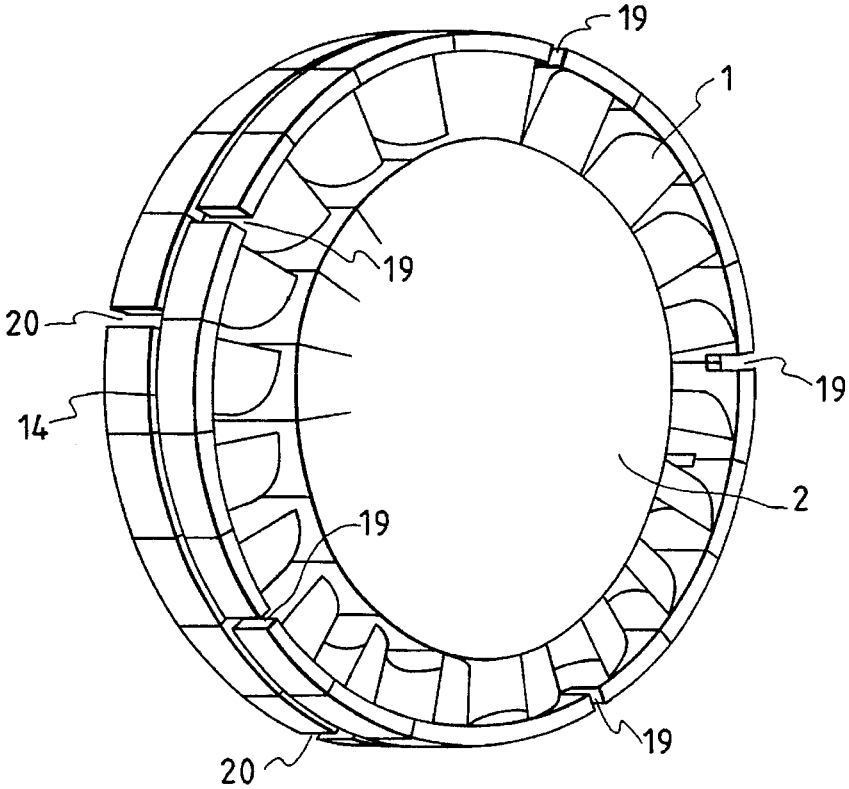
FIG. 28 is a partial view showing a blade apparatus of a third embodiment according to the present invention.

Next, a third embodiment according to the present invention will be explained. FIG. 28 is a perspective view showing an essential portion of the blade apparatus. This figure shows a state in which twenty blades 1 having comparatively short lengths are installed on the disc 2.

Figure 29:
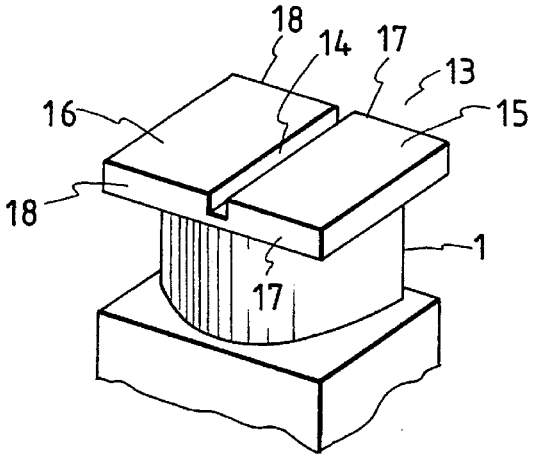
FIG. 29 is a partial view showing a portion of one blade which is included a third embodiment according to the present invention.
Figure 30:
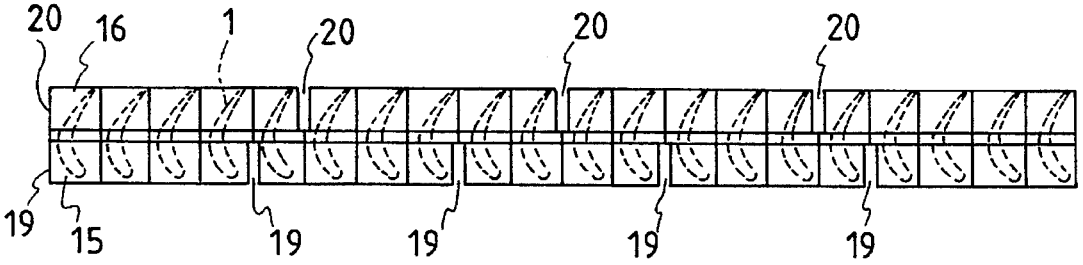
FIG. 30 is a developing plan view showing a blade structure taken from an outer peripheral side of a radial direction of a third embodiment according to the present invention.

Further, FIG. 29 shows a state of one blade and FIG. 30 shows a developing plan view of the cover portion taken in a radial direction of the outer periphery side.

At the tip end portion of the blade 1, a cover 13 is formed integrally with the blade 1. At an outer peripheral face of the cover 13, a groove 14 is provided, and this groove 14 extends toward the circumferential direction. The cover 13 is divided into a front (upstream) cover 15 and a rear (downstream) cover 16.

The adjacent blades 1 are connected through the contact of the peripheral direction end faces of the cover 13, these circumferential direction end faces providing front cover end faces 17 and rear cover end faces 18.

As clearly shown in FIG. 28 and FIG. 30, in the blades 1 around the periphery, with respect to the front cover 15, a gap 19 is formed at intervals of every four blades 1 and the front cover end faces 17 of all other blades 1 are assembled so as to contact each other.

Besides, with respect to the rear cover 16, a gap 20 is formed at intervals of every five blades 1 and the rear cover end faces 18 of all other blades 1 are assembled so as to contact each other.

As stated above, by the blade connecting structure which combines the front cover 16 and the rear cover 17, the blade structure is formed to have blades 1 around the periphery so as to provide a structure of one period.

Further, in the above explanation, it is indicated that the gaps 19 and 20 are provided periodically with respect to the front cover 16 and the rear cover 17; however, from the aspect of the present invention, it is preferable to change periodically the connecting force of the blades 1.

Figure 31:
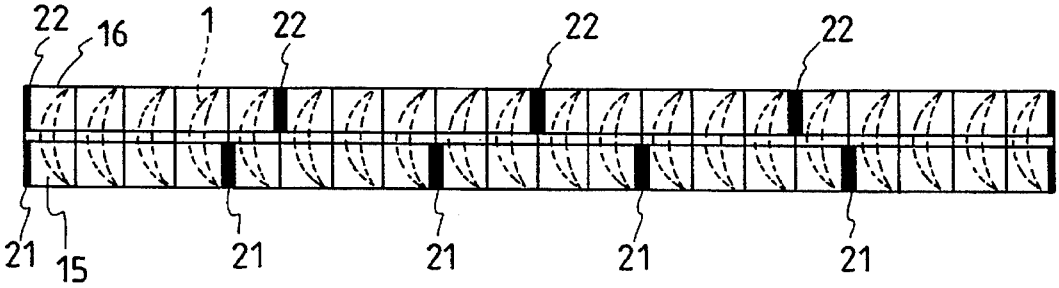
FIG. 31 is a developing plan view showing a blade structure taken from an outer peripheral side of a radial direction of a third embodiment according to the present invention.

For example, as shown in FIG. 31, in the blades 1 of the periphery, with respect to the front cover 15, it may be desirable to provide a strong connecting portion 21 at intervals of every four blades 1, and to assemble the front cover end faces 17 of the front cover 15 of all other blades 1 so as to contact each other.

Besides, with respect to the rear cover 16, it may be desirable to provide a strong connecting portion 22 at intervals of every five blades 1, and to assemble the rear cover end faces 18 of the rear cover 16 of all other blades 1 to contact each other.

Figure 32:
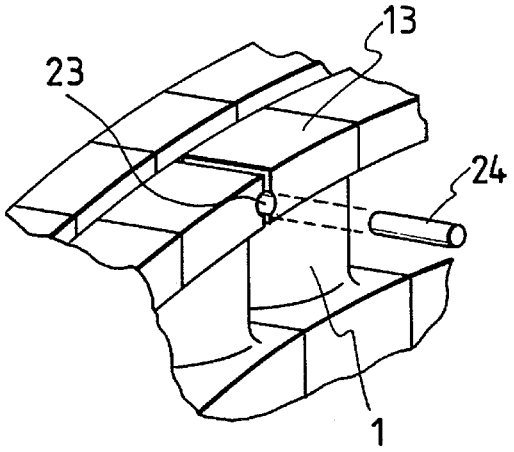
FIG. 32 is a partial view showing a portion of a blade structure of a third embodiment according to the present invention.

There are various methods for providing the strong connecting portions 21 and 22. As one example, as shown in FIG. 32, there is a method wherein, at the cover end faces opposing each other, a hole 23 is provided, and this hole 23 extends over a substantial length in the axis direction. Further, a pin 24 is inserted fixedly into this hole 23.

Figure 33:
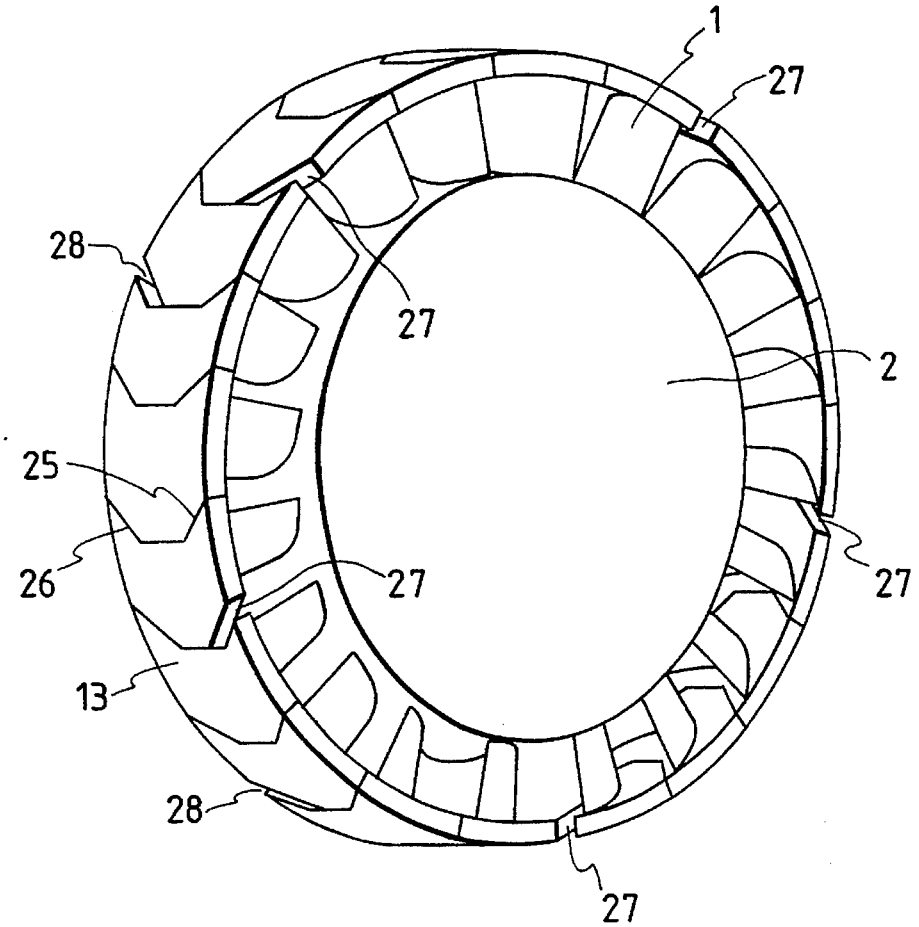
FIG. 33 is a partial view showing a portion of a blade structure of a fourth embodiment according to the present invention.
Figure 34:
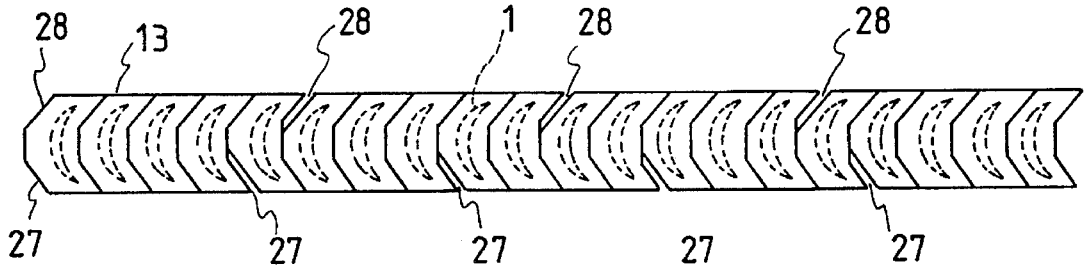
FIG. 34 is a developing plan view showing a blade structure taken from an outer peripheral side in a radial direction of a fourth embodiment according to the present invention.

Next, a fourth embodiment according to the present invention will be explained with reference to FIG. 33 and FIG. 34. In this case, similarly to the third embodiment, twenty blades 1 having comparatively short lengths are installed on the disc 2.

At the tip end portion of the blade 1, the cover 13 is formed integrally with the blade 1. The cover 13 provides a front side tapering face 25 and a rear side tapering face 26, as clearly understood by looking in the radial direction of the cover 13.

In the blades 1 around the periphery, with respect to the front side tapering face 25, a gap 27 is formed at intervals of every four blades 1, and the front side tapering faces 25 of all other blades 1 are assembled so as to contact each other.

Besides, with respect to the rear side tapering face 26, a gap 28 is formed at intervals of every five blades 1, and the rear side tapering faces 26 of all other blades 1 are assembled so as to contact each other.

As stated above, by the blade connecting structure which combines the front side tapering face 25 and the rear side tapering face 26, the blade structure is formed to have the blades 1 around the periphery as a structure of one period.

Further, in this case the gaps 27 and 28 are provided periodically with respect to the front side tapering face 25 and the rear side tapering face 26; however, from the aspect of the gist of the present invention, it is preferable to change periodically the connecting force of the blade 1.

Figure 35:
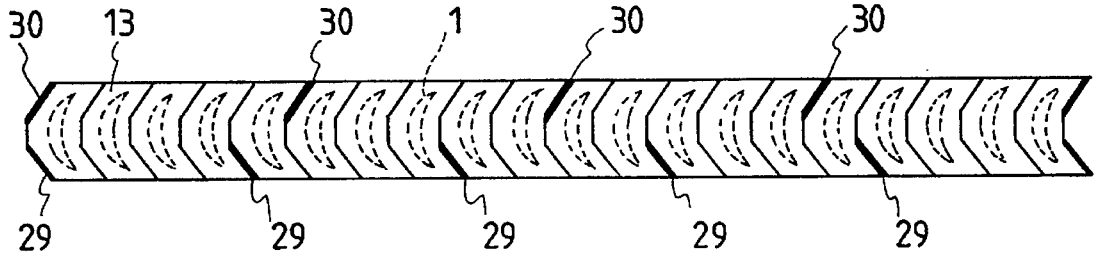
FIG. 35 is a developing plan view showing a blade structure taken from an outer peripheral side in a radial direction of a fourth embodiment according to the present invention.

For example, as shown in FIG. 35, with respect to the front side tapering face 25, it may be desirable to provide a strong connecting portion 29 at intervals of every four blades 1, and to assemble the front side tapering faces 25 of all other blades 1 so as to contact each other.

Besides, with respect to the rear side tapering face 26, it may be desirable to provide a strong connecting portion 30 at intervals of every five blades 1, and to assemble the rear side tapering end faces 26 of all other blades 1 so as to contact each other.

As the means for providing the strong connecting portions 29 and 30, similarly to the case of the third embodiment (FIG. 32), it may be desirable to employ a method in which a pin is inserted into a hole which is provided between the tapering faces.

Figure 36:
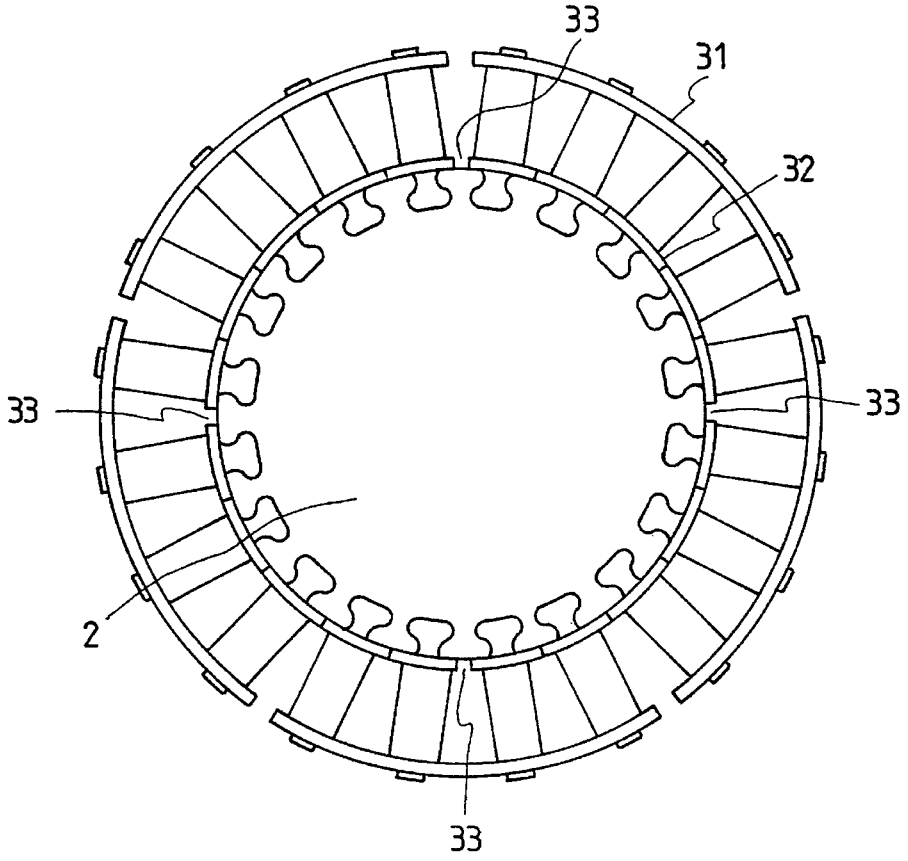
FIG. 36 is an axial front view showing a blade apparatus of a fifth embodiment according to the present invention.

Next, a fifth embodiment according to the present invention will be explained. FIG. 36 is a front view showing a blade connecting structure of the fifth embodiment according to the present invention taken in the axis direction of the steam turbine.

Similarly to the third embodiment, extending over the whole periphery, twenty blades 1 having comparatively short lengths are installed on the disc 2.

The tip end portion of the blade 1 is connected to a shroud 31, which is installed on the blade 1 by a caulking-tenon method. A blade group having four blades 1 as one blade group is formed, and five blade groups are repeated around the periphery.

Besides, at a root portion of the blade 1, a platform 32 is provided, and at the opposing portions of the platform 32 of the adjacent blades 1, a gap 33 is provided at intervals of every five blades 1, the platforms 32 of all other blades 1 being assembled to contact each other.

Thus, the blade connecting structure, which combines the shroud 31 with the platform 32, is formed to have the blades 1 around the periphery as a structure of one period.

Next, a sixth embodiment according to the present invention will be explained. As well known, when the rigidity of the blade and the rigidity of the disc are comparatively close, the blade and the disc perform a coupled vibration. In this sixth embodiment, a structure applicable to the above stated case will be explained.

Figure 37:
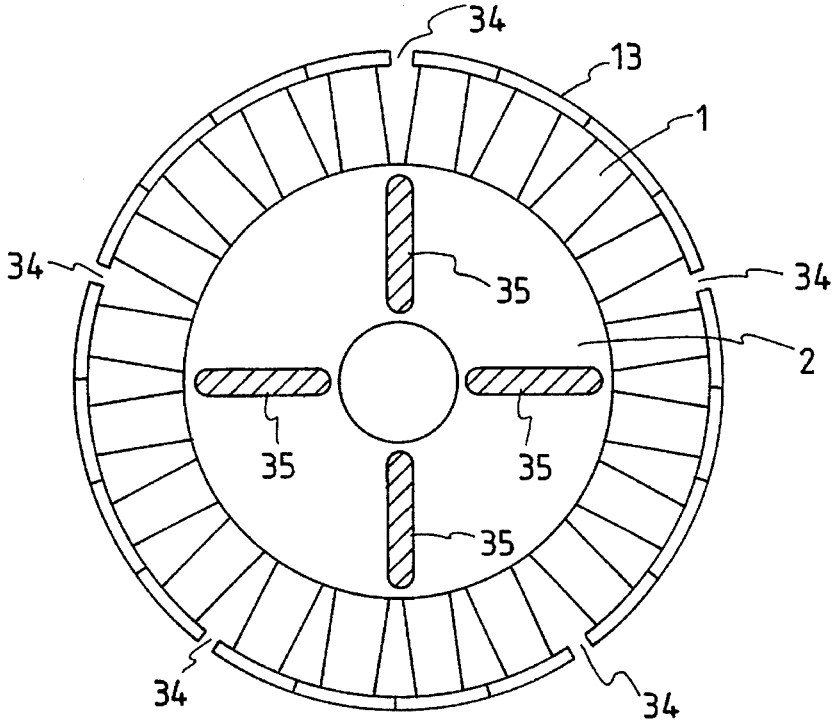
FIG. 37 is an axial front view showing a blade apparatus of a sixth embodiment according to the present invention.

FIG. 37 is a front view showing a blade connecting structure of the sixth embodiment according to the present invention taken from the axial direction of the steam turbine. Similarly to the third embodiment, extending over the whole periphery, twenty blades 1 having comparatively short lengths are installed on the disc 2.

At the tip end portion of the blade 1, the cover 13 is formed integrally with the blade 1. With respect to the opposing portions of the cover 13 of the adjacent blades 1, a gap 34 is provided at intervals of every four blades 1 and the opposing portions of all other blades 1 are assembled to contact each other.

Besides, in case in which the blade 1 and the disc 2 perform a coupled vibration, the disc 2 is considered as a part of the blade structure. Corresponding to the angle formed by every five blades 1, around the periphery, four varied thickness portions 35, where the disc thickness differs from the other thickness portions, are provided.

Thus, in the entire blade structure in which the blade groups with the disc 2 are combined, the blade connecting structure is formed to have an overall periphery formed as a structure of one period.

Figure 2:
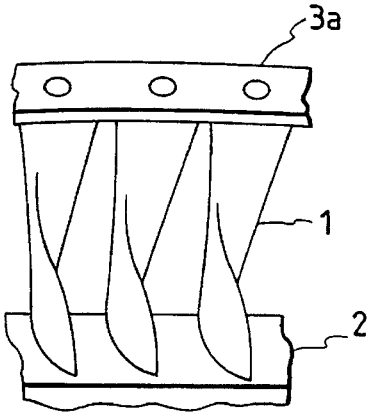
FIG. 2 PRIOR ART
FIG. 2 is a partial view showing an essential portion of a blade apparatus according to the prior art.
Figure 3:
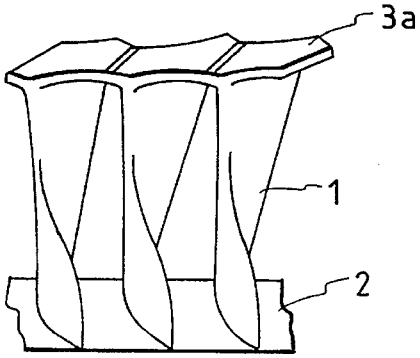
FIG. 3 PRIOR ART
FIG. 3 is a partial view showing an essential portion of a blade apparatus according to the prior art.
Figure 4:
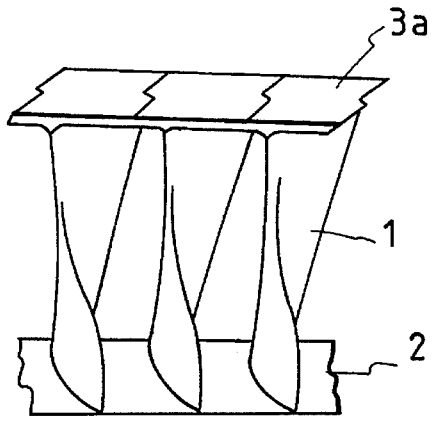
FIG. 4 PRIOR ART
FIG. 4 is a partial view showing an essential portion of a blade apparatus according to the prior art.
Figure 5:
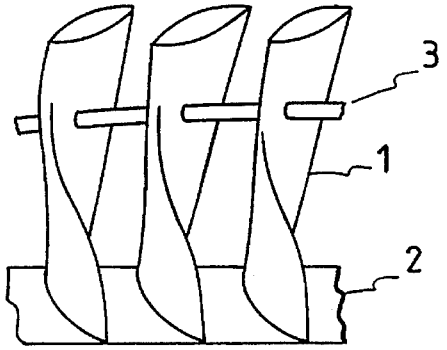
FIG. 5 PRIOR ART
FIG. 5 is a partial view showing an essential portion of a blade apparatus according to the prior art.
Figure 6:
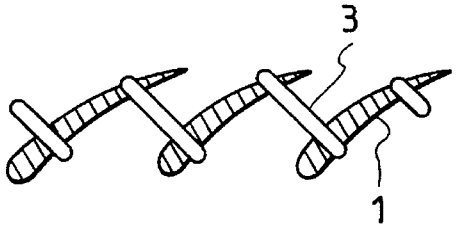
FIG. 6 PRIOR ART
FIG. 6 is a cross-sectional view showing an essential portion of a blade apparatus according to the prior art.
Figure 7:
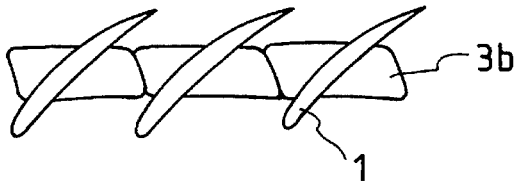
FIG. 7 PRIOR ART
FIG. 7 is a plan view showing an essential portion of a blade apparatus according to the prior art.
Figure 8:
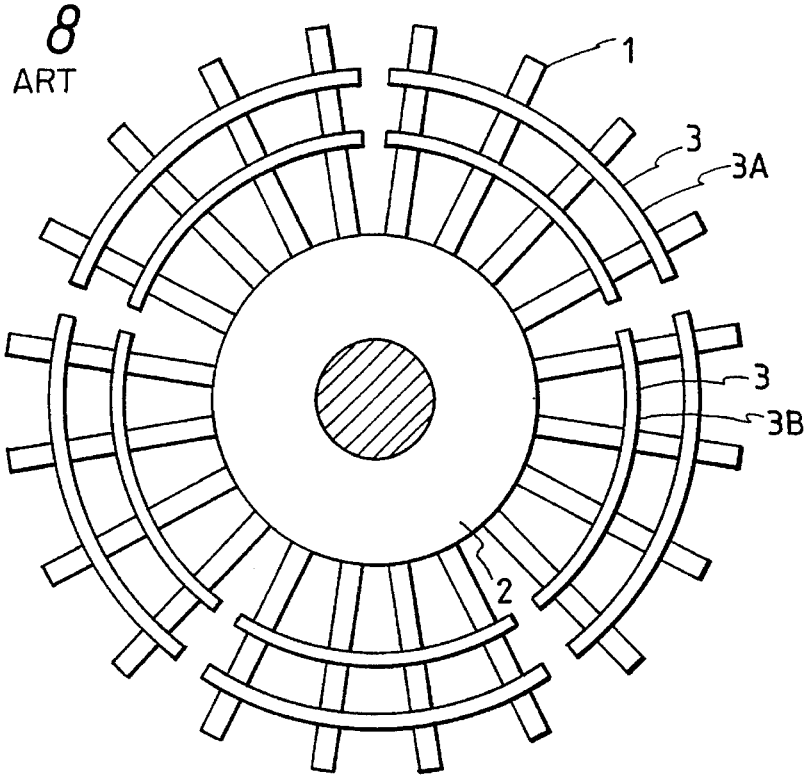
FIG. 8 PRIOR ART
FIG. 8 is a front view showing an essential portion of a blade apparatus according to the prior art.
Figure 9:
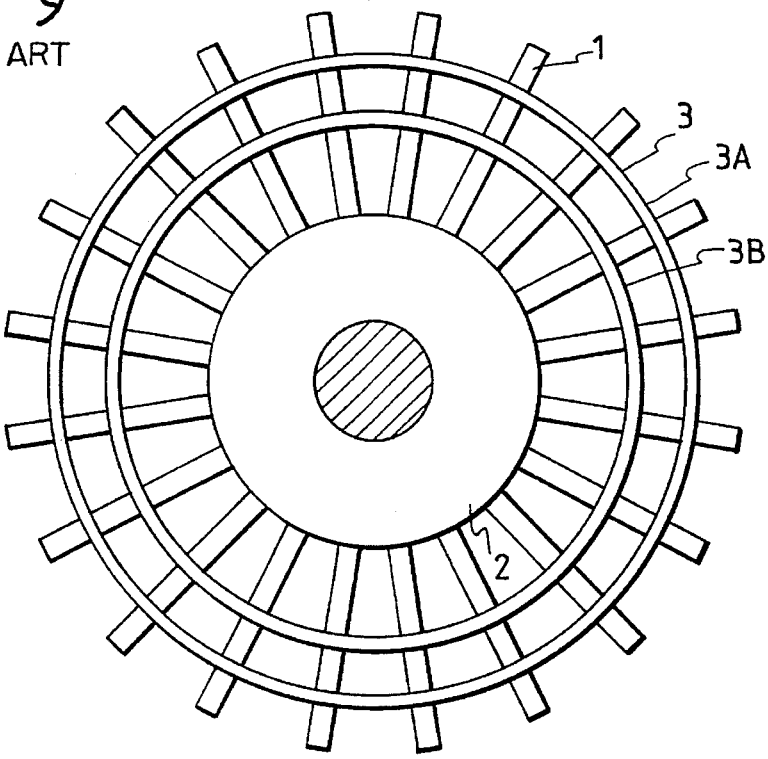
FIG. 9 PRIOR ART
FIG. 9 is a front view showing an essential portion of a blade apparatus according to the prior art.
Figure 10:
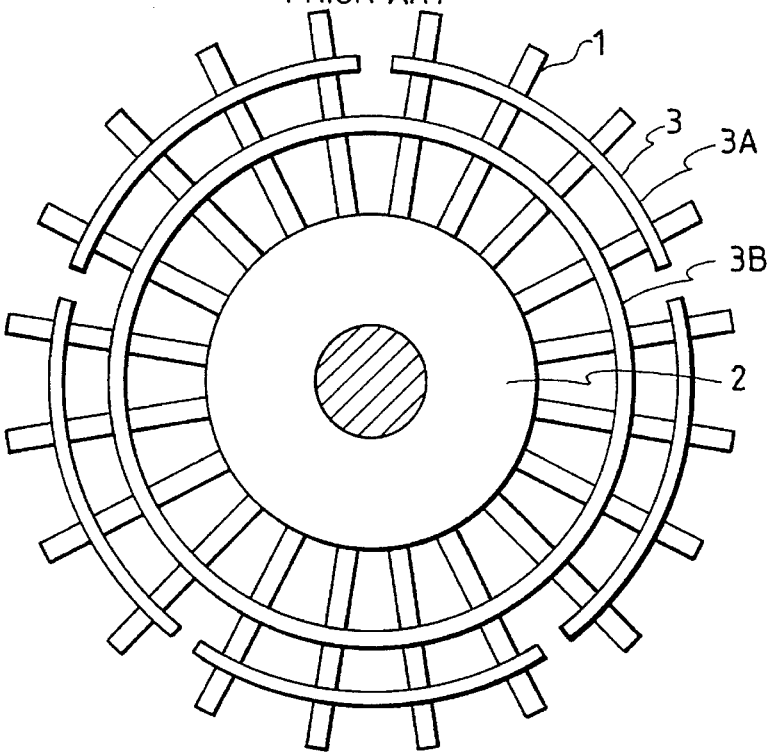
FIG. 10 PRIOR ART
FIG. 10 is a front view showing an essential portion of a blade apparatus according to the prior art.
Figure 11:
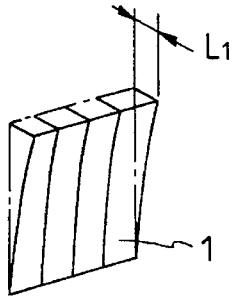
FIG. 11 is a partial view showing a state of a blade which receives an excitation force.
Figures 12A, 12B, 12C, 12D, 12E:
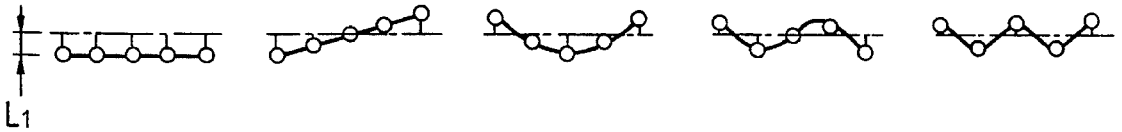
FIG. 12*a* is a plan view showing a state of a blade which receives an excitation force.
FIG. 12*b* is a plan view showing a state of a blade which receives an excitation force.
FIG. 12*c* is a plan view showing a state of a blade which receives an excitation force.
FIG. 12*d* is a plan view showing a state of a blade which receives an excitation force.
FIG. 12*e* is a plan view showing a state of a blade which receives an excitation force.
Figure 13:
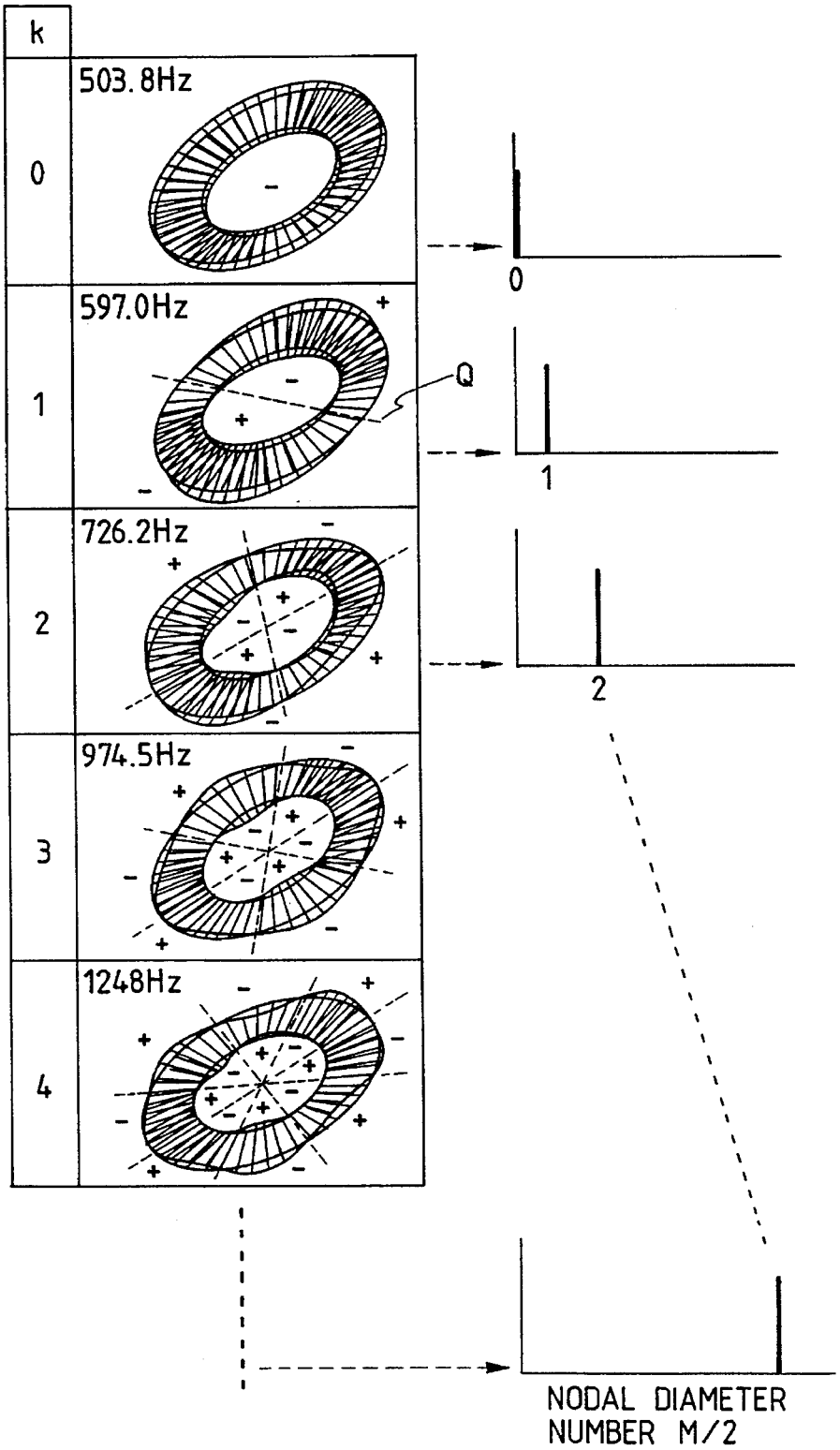
FIG. 13 is a schematic view illustrating an excitation component which acts on a blade during rotation.
Figures 14A, 14B:
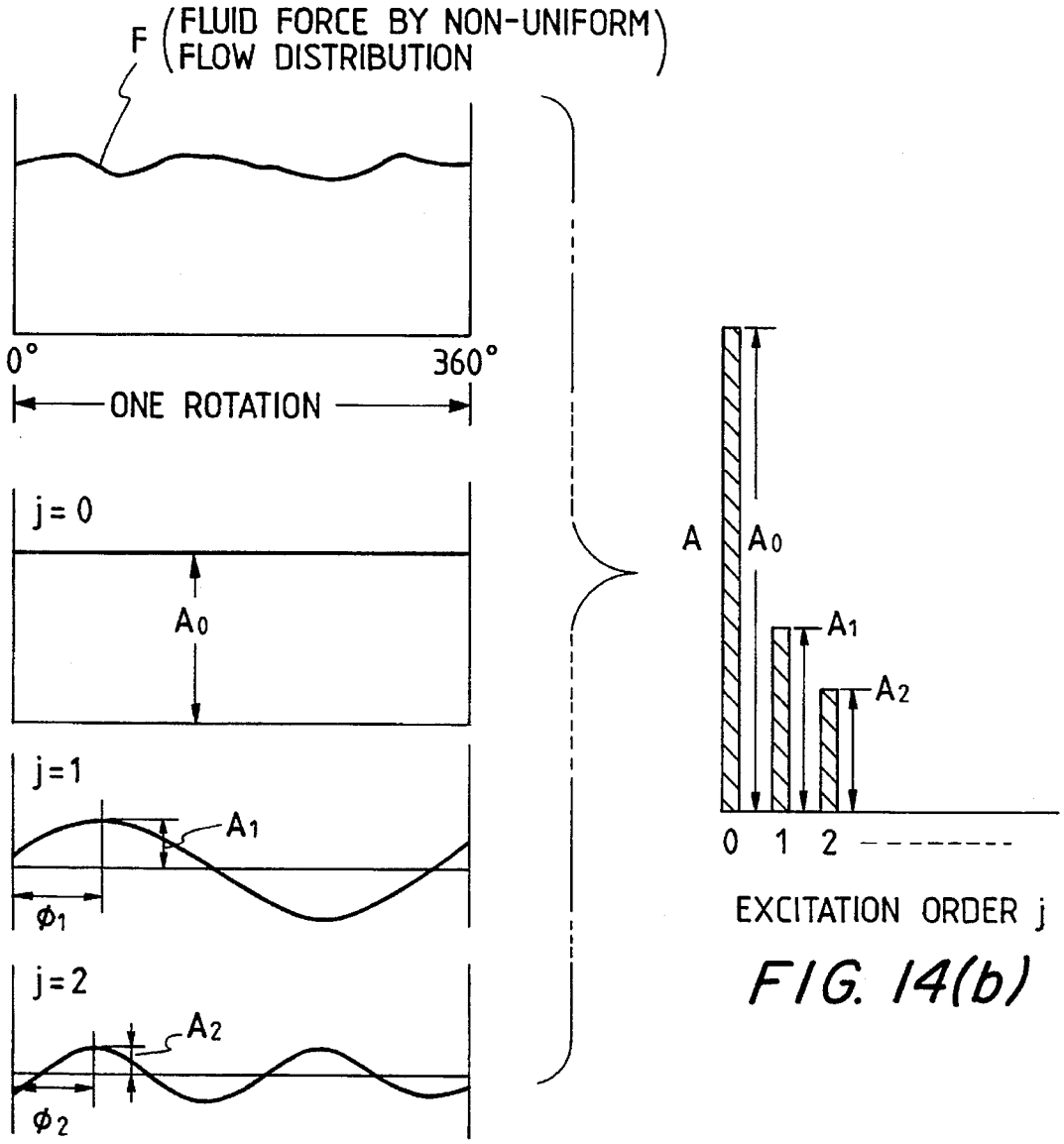
FIGS. 14(*a*) and 14(*b*) are schematic diagrams illustrating a vibration mode of a blade.
Figure 15:
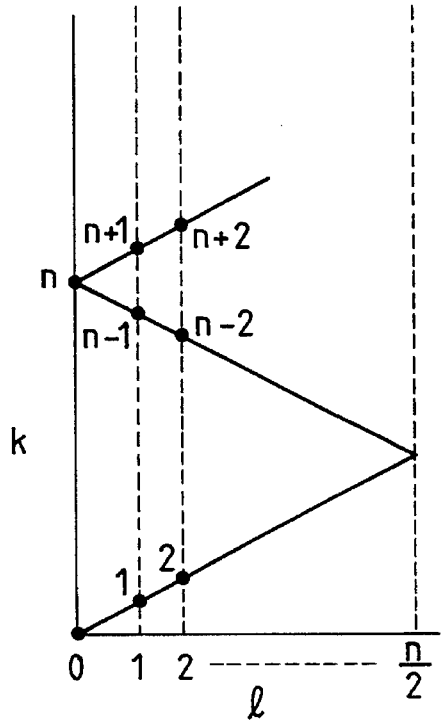
FIG. 15 PRIOR ART
FIG. 15 is a diagram illustrating a nodal diameter mode component which includes one nature vibration mode of a blade structure according to the prior art.
Figure 16:
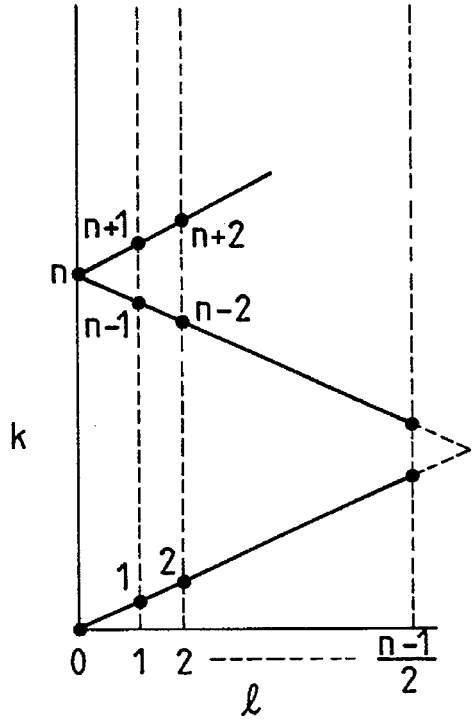
FIG. 16 PRIOR ART
FIG. 16 is a diagram illustrating a nodal diameter mode component which includes one natural vibration mode of a blade structure according to the prior art.
Figure 17:
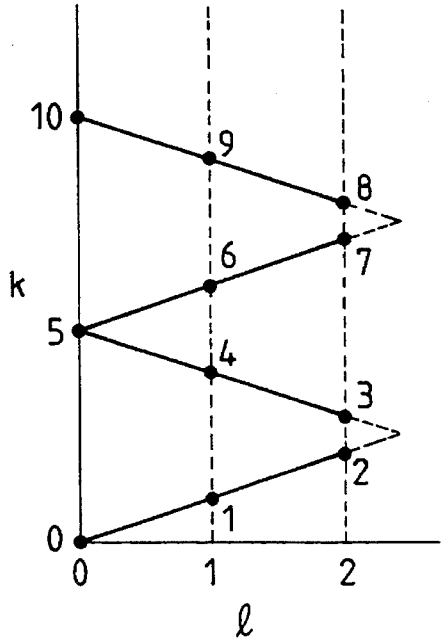
FIG. 17 PRIOR ART
FIG. 17 is a diagram illustrating a nodal diameter mode component which includes one natural vibration mode of a concrete blade structure according to the prior art.
Figure 18:
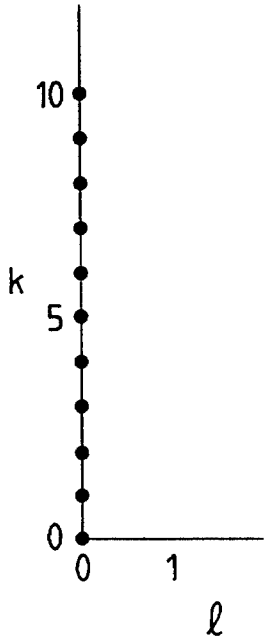
FIG. 18 is a diagram illustrating a nodal diameter mode component which includes one natural vibration mode of a concrete blade structure according to the present invention.

In the above explanation, in the embodiments from the first embodiment to the sixth embodiment, the combination of a particular blade connecting structure is shown to limit every embodiment. However, without deviating from the gist of the present invention, it is possible to employ other combinations or the combination of the blade connecting structure shown in FIG. 2 and FIG. 3.

Further, in the above explanations, as an example of a multiple stage connecting structure, a double stage connecting structure is exemplified; however, it can be provided as a triple stage connecting structure as well.

Further, with respect to a multiple stage connecting structure which is greater than a triple stage connecting structure, at least one pair of the double stage connecting structure can be utilized, when the blade connection satisfies the condition stated above.

The above fact can be understood easily, although not necessarily shown in the figure, from the fact that, even when a single connecting structure is added to the various double stage connecting structures described above so that a triple stage connecting structure is obtained, it is necessary to provide a blade structure having blades around the periphery formed as a structure of one period.

Further, using an analogy to the explanation of the present invention showing a double stage connecting structure, another example which is able to extend to more than a triple stage connecting structure will be explained.

Now, it is assumed that the blades are constituted as a p multiple stage connecting structure ($p2 \geqq 3$), the connecting number (the periodic structure unit) of the respective connecting structure set as $N_1, N_2, \ldots N_p$.

The condition in which this p multiple connecting structure becomes a blade structure having the whole periphery formed as a structure of one period is that the total blade number M around the periphery is equal to the product of $N_1, N_2, \ldots N_p$, and each of $N_1, N_2, \ldots$, Np has respectively no common divisor except 1.

Figure 38:
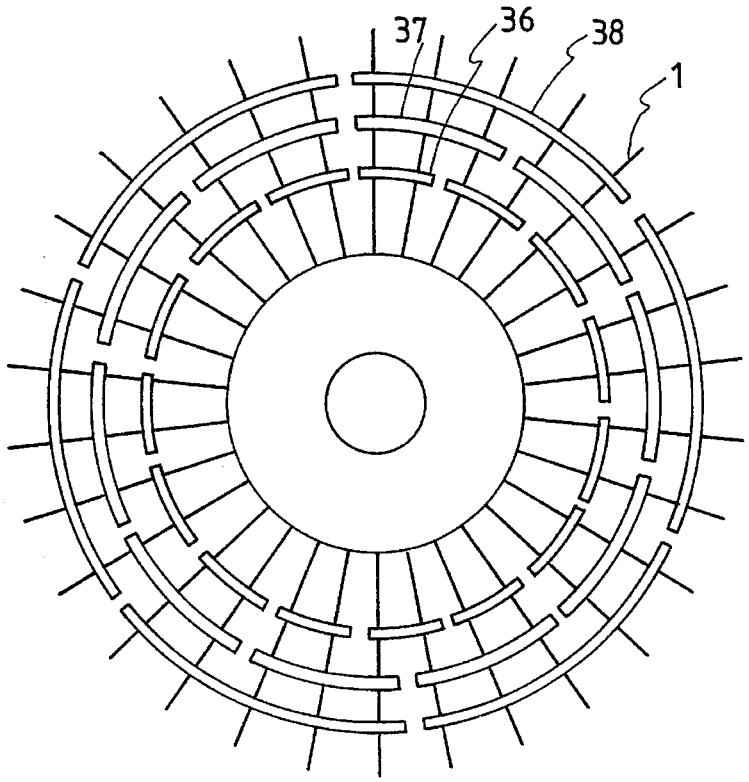
FIG. 38 is an axial front view showing a blade structure which shows a triple blade connecting structure according to the present invention.

A blade apparatus as described above is shown in FIG. 38. A detected explanation is omitted herein; however, in this example, M is 30 (M=30) and p is 3 (p=3). Accordingly, for the connecting members 36, 37 and 38, $N_1$ becomes 2 ($N_1$=2), $N_2$ becomes 3 ($N_2$=3) and $N_3$ becomes 5 ($N_3$=3), respectively.

We claim:

1. A blade apparatus for fluid machinery comprising: plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the blades of each first integer number ($N_1$) blade group are connected by one of said first stage connecting members; and the blades of each second integer number ($N_2$) blade group are connected by one of said second stage connecting members.

2. A blade apparatus for fluid machinery comprising: plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the blades of each first integer number ($N_1$) blade group are connected by one of said first stage connecting members;

said first integer number ($N_1$) blade group is formed to include some blades of the second integer number ($N_2$) blade group around said outer periphery; and the blades of each second integer number ($N_2$) blade group are connected by one of said second stage connecting members; and said second integer number ($N_2$) blade group is formed to include some blades of the first integer number ($N_1$) blade group around said outer periphery.

3. A blade apparatus for fluid machinery comprising:

plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the blades of each first integer number ($N_1$) blade group are connected by one of said first stage connecting members;

the blades of each second integer number ($N_2$) blade group are connected by second stage connecting members; and the number of said divided blade groups is selected to have the same integer number as said plural stages of said connecting members.

4. A blade apparatus for fluid machinery comprising:

plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

said plural blades are divided into at least first blade groups each having blades of a first integer number ($N_1$) and second blade groups each having blades of a second integer number ($N_2$);

the first integer number ($N_1$) and the second integer number ($N_2$) having no common divisor except 1;

one of said first stage connecting members connects the blades of a respective first integer number ($N_1$) blade group;

one of said second stage connecting members connects the blades of a respective second integer number ($N_2$) blade group; and the number of stages of said plural connecting members being equal in all of said plural blades.

5. A blade apparatus for fluid machinery comprising: plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the connecting strength of said first stage connecting members is changed periodically for every first integer number ($N_1$) blade group at said outer periphery with a first period having the second integer number ($N_2$); and the connecting strength of said second stage connecting members is changed periodically for every second integer number ($N_2$) blade group at said outer periphery with a second period having the first integer number ($N_1$).

6. A blade apparatus for a fluid machinery according to any one of claims 1–5 wherein at least one of said first stage connecting members and said second stage connecting members are formed by tie wires.

7. A blade apparatus for a fluid machinery according to any one of claims 1–5, characterized in that two adjacent ones of said connecting members are joined with a flexible member which is softer than said connecting members.

8. A blade apparatus for a fluid machinery according to any one of claims 1–5, wherein said plural stage connecting members of the respective first stage and second stage connecting members are formed at the same radial diameter position of said adjacent blades.

9. A blade apparatus for a fluid machinery according to any one of claims 1–5 characterized in that two adjacent ones of said connecting members are connected loosely through a sleeve.

10. A blade apparatus for a fluid machinery comprising: plural blades formed at spaced locations on an outer periphery of a blade wheel, said plural blades being divided into blade groups in which the blades are connected to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

the total number (M) of said plural blades is the product of a first integer number ($N_1$) and a second integer number ($N_2$);

each of the first integer number ($N_1$) and the second integer number ($N_2$) having no common divisor except 1;

the connecting strength of said first stage connecting members is changed periodically for every group of said plural blades having the first integer number ($N_1$); and the connecting strength of said second stage connecting members is changed periodically for every group of said plural blades having the second integer number ($N_2$);

thereby a connecting structure of said plural connecting members as a whole from an aspect of the connecting strength of said plural connecting members is formed to make the blades around said outer periphery appear as a structure of one period.

11. A fluid machinery having a blade apparatus comprising:

plural blades formed at spaced locations on an outer periphery of a blade wheel, said plural blades being divided into predetermined blade groups, said plural blades of said divided blade groups being connected within each group to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the blades of each first integer number ($N_1$) blade group are connected by one of said first stage connecting members; and the blades of each second integer number ($N_2$) blade group are connected by one of said second stage connecting members.

12. A fluid machinery having a blade apparatus comprising:

plural blades formed at spaced locations on an outer periphery of a blade wheel, said plural blades being divided into a plurality of predetermined blade groups, said plural blades of said divided blade groups being connected within each group to each other by plural connecting members, and said plural connecting members being formed in plural stages including at least first stage connecting members and second stage connecting members, wherein:

the total number (M) of said plural blades is selected so as not to be either a prime number or a power multiplier of a prime number;

said plural blades are divided into at least first blade groups in which each first blade group has blades of a first integer number ($N_1$) and second blade groups in which each second blade group has blades of a second integer number ($N_2$);

the first integer number ($N_1$) and the second integer number ($N_2$) having no common divisor except 1;

the total number (M) of said plural blades is the product of the first integer number ($N_1$) and the second integer number ($N_2$);

the blades of each first integer number ($N_1$) blade group are connected by one of said first stage connecting members;

said first integer number ($N_1$) blade group is formed to include some blades of the second integer number ($N_2$) blade group around said outer periphery; and the blades of each second integer number ($N_2$) blade group are connected by one of said second stage connecting members; and said second integer number ($N_2$) blade group is formed to include some blades of the first integer number ($N_1$) blade group around said outer periphery.

* * * * *